US008523534B2

(12) United States Patent
Spinelli et al.

(10) Patent No.: US 8,523,534 B2
(45) Date of Patent: Sep. 3, 2013

(54) HIGH-PRESSURE PUMP FOR SUPPLYING FUEL TO AN INTERNAL-COMBUSTION ENGINE

(75) Inventors: Vito Spinelli, Bari (IT); Antonio Grimaldi, Bari (IT); Nello Medoro, Trinitapoli (IT)

(73) Assignee: Robert Bosch GmbH, Stuttgart (DE)

( * ) Notice: Subject to any disclaimer, the term of this patent is extended or adjusted under 35 U.S.C. 154(b) by 484 days.

(21) Appl. No.: 12/663,648

(22) PCT Filed: Jun. 11, 2008

(86) PCT No.: PCT/EP2008/057265

§ 371 (c)(1),
(2), (4) Date: Dec. 8, 2009

(87) PCT Pub. No.: WO2008/152051

PCT Pub. Date: Dec. 18, 2008

(65) Prior Publication Data

US 2010/0183449 A1 Jul. 22, 2010

(30) Foreign Application Priority Data

Jun. 14, 2007 (IT) ..... M12007A1202

(51) Int. Cl.
*F04B 23/12* (2006.01)

(52) U.S. Cl.
USPC ..... 417/206; 417/273; 418/3; 418/9; 464/179

(58) Field of Classification Search
USPC ..... 417/206, 273; 418/3, 5, 9, 102, 418/166, 171, 206.1; 464/179, 182
See application file for complete search history.

(56) References Cited

U.S. PATENT DOCUMENTS 2,142,239 A * 1/1939 Cook ..... 72/322
2,275,177 A * 3/1942 Crans ..... 148/220
3,708,250 A 1/1973 Thumm (Continued)

FOREIGN PATENT DOCUMENTS

DE 2417383 A1 10/1975
DE 247251 A1 7/1987

(Continued)

OTHER PUBLICATIONS

Product Engineering Design Manual by Douglas C. Greenwood (McGraw-Hill Book Company 1959).*
Industrial Engineering by William Barr published Dec. 1918, p. 569.*

*Primary Examiner* — Devon Kramer
*Assistant Examiner* — Thomas Fink
(74) *Attorney, Agent, or Firm* — Michael Best & Friedrich LLP

(57) ABSTRACT

A high-pressure pump for supplying fuel to an internal-combustion engine has a pump body and an actuating shaft which extends along a longitudinal axis and which is supported rotatably about the longitudinal axis by the pump body. The shaft has an eccentric portion and a prismatic jacking end. A first pumping station has a gear engaged with the prismatic jacking end and a second pumping station has at least one piston. The piston is slidable relative to the pump body transversely with respect to the longitudinal axis and is actuated by the eccentric portion of the actuating shaft. The prismatic jacking end is made of a harder material than the material with which the remainder of the actuating shaft is made.

8 Claims, 2 Drawing Sheets

(56) References Cited

U.S. PATENT DOCUMENTS

| | | | | | |
|---|---|---|---|---|---|
| 3,740,829 | A | * | 6/1973 | Yarger | 228/135 |
| 4,265,388 | A | * | 5/1981 | Takahashi et al. | 228/135 |
| 4,638,683 | A | * | 1/1987 | Ogawa et al. | 74/567 |
| 4,679,960 | A | * | 7/1987 | Mizuhara | 403/272 |
| 4,685,871 | A | * | 8/1987 | Harwath | 418/206.1 |
| 4,891,972 | A | * | 1/1990 | Kawaguchi et al. | 73/114.79 |
| 5,603,075 | A | | 2/1997 | Stoll et al. | |
| 5,658,678 | A | | 8/1997 | Stoll et al. | |
| 5,713,333 | A | | 2/1998 | Cooper et al. | |
| 5,802,955 | A | | 9/1998 | Stoll et al. | |
| 5,829,411 | A | | 11/1998 | Cooper et al. | |
| 7,895,982 | B2 | * | 3/2011 | Moss et al. | 123/90.6 |
| 2001/0015200 | A1 | | 8/2001 | Mori | |
| 2007/0071614 | A1 | | 3/2007 | Inoue | |

FOREIGN PATENT DOCUMENTS

| | | | |
|---|---|---|---|
| GB | 1341483 | | 12/1973 |
| JP | 11280641 | | 10/1999 |
| WO | 9627687 | A1 | 9/1996 |
| WO | 2004048768 | A1 | 6/2004 |
| WO | WO 2004048768 | A1 * | 6/2004 |

* cited by examiner

HIGH-PRESSURE PUMP FOR SUPPLYING FUEL TO AN INTERNAL-COMBUSTION ENGINE

CROSS-REFERENCE TO RELATED APPLICATION

This application is a 35 USC 371 application of PCT/EP 2008/057265 filed on Jun. 11, 2008.

BACKGROUND OF THE INVENTION

1. Field of the Invention

In particular, the present invention relates to a high-pressure piston pump for supplying fuel in a common-rail circuit of an internal-combustion engine.

2. Description of the Prior Art

A piston pump of this type generally includes a pump body. A shaft, which extends along a longitudinal axis, is supported rotatably about the longitudinal axis by the pump body and has an eccentric portion and a prismatic jacking end. A first pumping station has a gear engaged with the prismatic jacking end. A second pumping station has at least one piston, which is slidable inside the pump body transversely with respect to the longitudinal axis and which is actuated by the eccentric portion of the shaft.

The first pumping station essentially has a gear pump which produces a first relatively small pressure difference, while the second pumping station generally comprises three pistons which produce a large pressure difference, also greater than 1600 bar in the high-pressure pumps which are currently manufactured, and destined to increase in order to improve further the performance features of internal-combustion engines.

The first pumping station essentially comprises a gear pump which produces a first relatively small pressure difference, while the second pumping station generally comprises three pistons which produce a large pressure difference, also greater than 1600 bar in the high-pressure pumps which are currently manufactured, and destined to increase in order to improve further the performance features of internal-combustion engines.

High-pressure pumps pose problems of wear of certain components such as the prismatic jacking end of the shaft which, during use, is engaged with a gear generally made of sintered material. At present, the actuating shaft of a high-pressure pump is made of 16MnCrS5 steel which undergoes a surface hardening heat treatment. However, the prismatic jacking end is subject to greater wear than the remainder of the shaft and is the main cause of a relative short working life of the high-pressure pump.

ADVANTAGES AND SUMMARY OF THE INVENTION

The object of the present invention is to provide a high-pressure pump for an internal-combustion engine which does not have the drawbacks of the known art and which, in particular, is particularly low-cost.

According to the present invention a high-pressure pump for an internal-combustion engine is provided. The pump includes a pump body. A shaft, which extends along a longitudinal axis, is supported rotatably about the longitudinal axis by the pump body and has an eccentric portion and a prismatic jacking end. A first pumping station has a gear engaged with the prismatic jacking end. A second pumping station has at least one piston, which is slidable inside the pump body transversely with respect to the longitudinal axis and which is actuated by the eccentric portion of the shaft. The high-pressure pump according to the invention further providing that the prismatic jacking end is made of a first material and the remainder of the shaft is made of a second material, where the first material being harder than the second material.

According to the present invention, the wear of the shaft is limited substantially and uniformly spread over the various parts. Consequently, the working life of the high-pressure pump is increased as a whole.

BRIEF DESCRIPTION OF THE DRAWINGS

Further characteristic features and advantages of the present invention will become clear from the description of an exemplary embodiment thereof which follows, provided with reference to the accompanying figures in which.

DESCRIPTION OF THE PREFERRED EMBODIMENT

Figure 1:
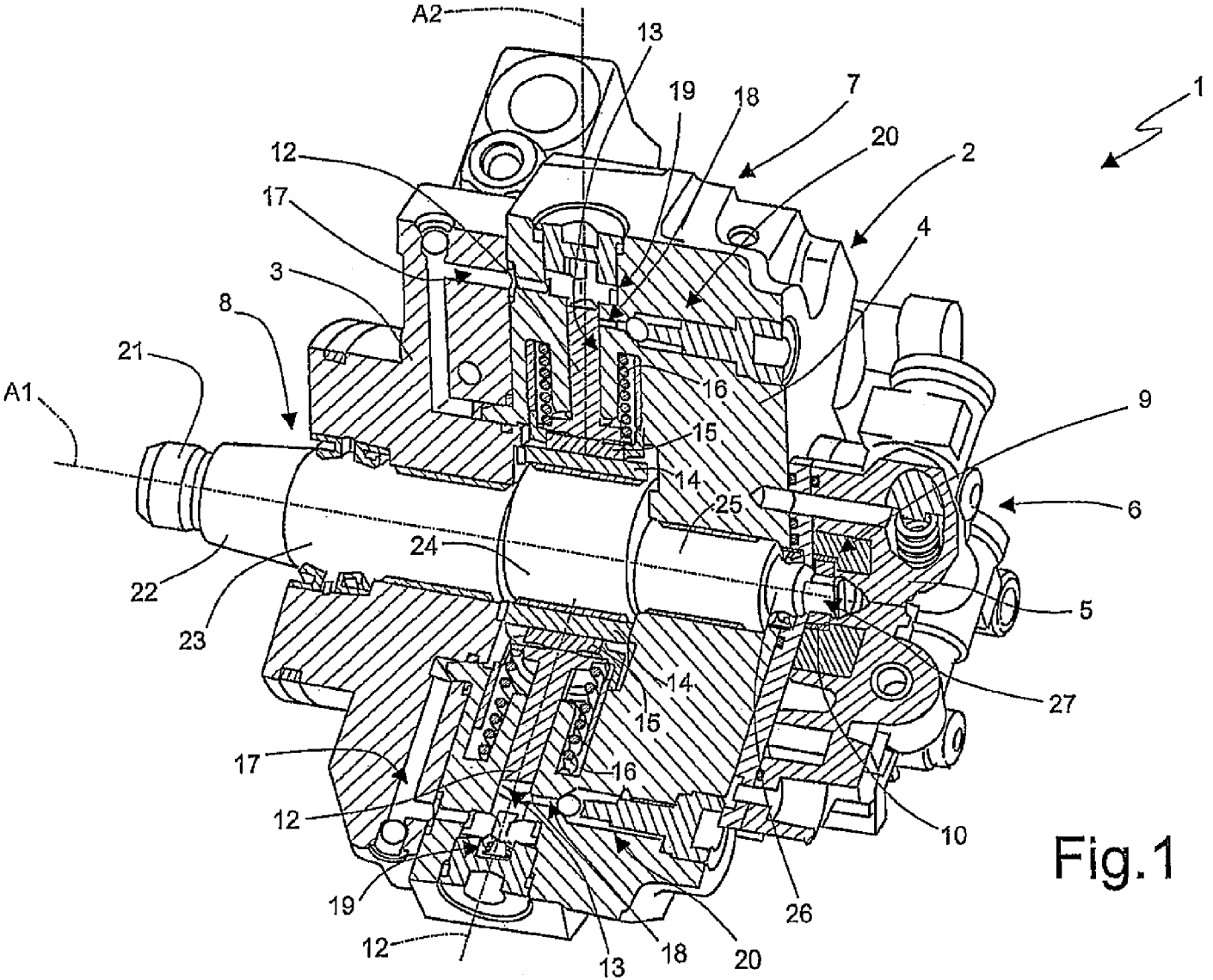
FIG. 1 is a perspective view, with parts cross-sectioned and parts removed for the sake of clarity, of a high-pressure pump provided in accordance with the present invention.

In FIG. 1, 1 denotes in its entirety a high-pressure pump which is able to compress the fuel to pressures greater than 2,200 bar in order to feed the fuel to a common rail of an internal-combustion engine not shown in the accompanying figures.

The pump 1 comprises a pump body 2 defined by three metallic bodies 3, 4 and 5 assembled together; a low-pressure pumping station 6 and a high-pressure pumping station 7; and a shaft 8 which extends along a longitudinal axis A1 and is able to actuate simultaneously the low-pressure pumping station 6 and the high-pressure pumping station 7.

The low-pressure pumping station 6 is arranged in the pump body 2 and comprises a gear pump 9, a gear 10 of which, arranged in a seat 11 of the pump body 2, is shown in FIG. 1.

The high-pressure station 7 comprises three pistons 12, each of which extends along an axis A2 in a substantially radial direction with respect to the longitudinal axis A1 and is slidable inside a cylinder 13 formed in the pump body 2.

Each piston 12 is actuated along the axis A2 of the shaft 8 which, via the intervening arrangement of a hub 14 and a cup 15, produces compression of the fuel against the action of an opposition spring 16.

The feed conduits 17, delivery conduits 18, feed valves 19 and the delivery valves 20 are formed inside the pump body 2.

The shaft 8 is supported rotatably about the longitudinal axis A1 by the pump body 2 and comprises in succession a jacking pad end 21, a conical portion 22, a cylindrical portion 23, an eccentric portion 24, a cylindrical portion 25, a cylindrical portion 26 with a diameter smaller than the portion 25 and a prismatic jacking end 27 which, during use, is inserted in the gear 10.

Figure 2:
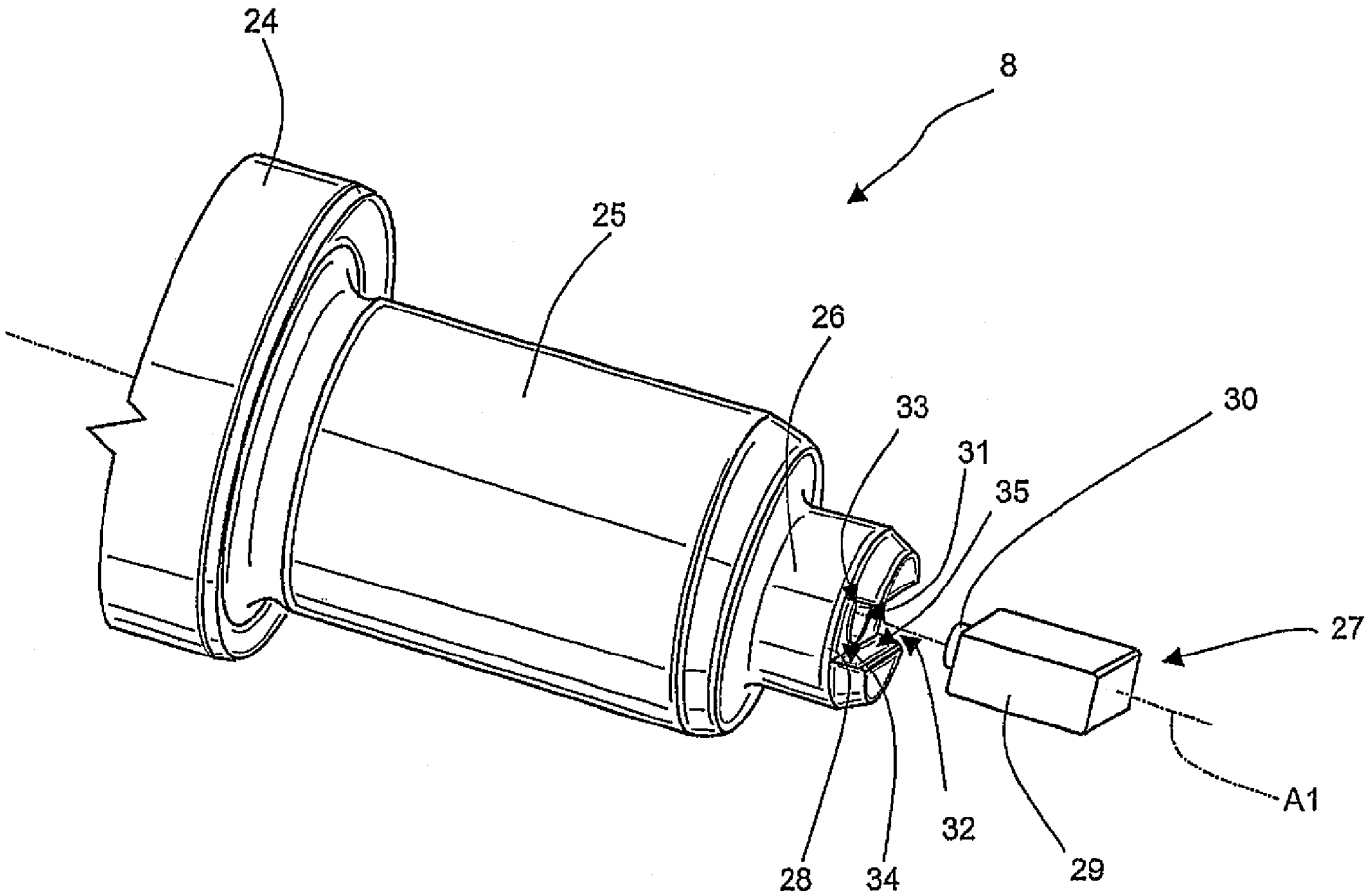
FIG. 2 is an exploded perspective view, on a larger scale and with parts removed for the sake of clarity, of a detail of the high-pressure pump of FIG. 1.

With reference to FIG. 2 the shaft 8 is formed by joining together the prismatic jacking end 27 with the remainder of the shaft 8. The prismatic jacking end 27 is made of sintered carbide, more specifically sintered tungsten carbide, while the remainder of the shaft is made of steel, more specifically 16MnCrS steel.

The joint between the prismatic jacking end 27 and the remainder of the shaft 8 is performed by means of a brazewelding method. The shaft 8 is then subjected to a heat treatment in order to obtain surface hardening.

The remainder of the shaft 8, more specifically the cylindrical portion 26, has a pocket 28 able to house partly the prismatic jacking end 27.

The prismatic jacking end 27 comprises a prismatic body 29 and an end lug 30 with a circular cylindrical form which, during use, is coaxial with the cylindrical portion 26.

The pocket 28 has a seat 31 for housing the end lug 30 and a seat 32 for housing the prismatic body 29.

More specifically, the seat 31 is delimited by a surface 33 matching the end lug 30, while the second seat 32 is delimited by a bottom surface 34 and by two lateral surfaces 35 parallel to and facing each other and matching the prismatic body 29.

Production of the shaft 8 is performed as follows: the prismatic jacking end 27 is formed by means of sintering of tungsten carbide powders, while the remainder of the shaft 8 is produced by means of lathe-machining and milling. The prismatic jacking end 27 is inserted in the pocket 28. The lug end 30 engaged with the first seat performs centring of the prismatic jacking end 27 with respect to the remainder of the shaft along the longitudinal axis A1, while insertion of the prismatic body 29 between the lateral walls 35 prevents rotation of the prismatic jacking end 27 about the longitudinal axis A1 relative to the remainder of the shaft 8.

The shaft 8, after definition of its form, is braze-welded so as to produce an irreversible joint between the prismatic jacking end 27 and the remainder of the shaft 8 and subsequently subjected to a surface-hardening heat treatment.

The foregoing relates to the preferred exemplary embodiment of the invention, it being understood that other variants and embodiments thereof are possible within the spirit and scope of the invention, the latter being defined by the appended claims.

The shaft 8 thus produced has a prismatic jacking end 27 which has a hardness greater than the remainder of the shaft and able to limit substantially the wear of the parts of the prismatic jacking end 27 in contact with the gear 10, which is preferably made of sintered carbide.

The invention claimed is:

1. A high-pressure pump for supplying fuel to an internal-combustion engine, the pump comprising:

a pump body;

a shaft, which extends along a longitudinal axis, is supported rotatably about the longitudinal axis by the pump body, the shaft having an eccentric portion and a prismatic jacking end;

a first pumping station having a gear engaged with the prismatic jacking end; and a second pumping station having at least one piston which is slidable inside the pump body transversely with respect to the longitudinal axis, the piston being actuated by the eccentric portion of the shaft, wherein the prismatic jacking end is made of a first material and a remainder of the shaft is made of a second material, the first material being harder than the second material, wherein the remainder of the shaft comprises an engaging portion with a pocket housing partly the prismatic jacking end, and wherein the prismatic jacking end comprises a prismatic body and an end lug, the pocket comprising a first seat for housing the end lug and a second seat for housing the prismatic body.

2. The pump according to claim 1, wherein the prismatic jacking end is braze-welded to the remainder of the shaft.

3. The pump according to claim 1, wherein the end lug has a circular cylindrical form and wherein the first seat is delimited by a surface having a form matching the end lug.

4. The pump according to claim 1, wherein the second seat is delimited, by a bottom wall and by two lateral walls parallel to and facing each other and matching the prismatic body.

5. The pump according to claim 2, wherein the second seat is delimited, by a bottom wall and by two lateral walls parallel to and facing each other and matching the prismatic body.

6. The pump according to claim 3, wherein the second seat is delimited, by a bottom wall and by two lateral walls parallel to and facing each other and matching the prismatic body.

7. The pump according to claim 1, wherein the prismatic jacking end is made of sintered carbide.

8. The pump according to claim 7, wherein the remainder of the shaft is made of 16MnCrS steel.

* * * * *